US008082664B2

(12) United States Patent
Dohmen et al.

(10) Patent No.: US 8,082,664 B2
(45) Date of Patent: Dec. 27, 2011

(54) HARNESS MAKING DEVICE AND METHOD FOR THE PRODUCTION OF CABLE HARNESSES

(75) Inventors: Barbara Dohmen, Rossdorf (DE); Juergen Dommel, Stoedtlen-Gaxhardt (DE); Michael Gerst, Worms (DE); Horst Knapp, Gross-Zimmern (DE); Martin Lipp, Gau-Bischofsheim (DE); Klaus Traiser, Gross-Gerau (DE); Joerg Vesper, Wuppertal (DE); Matthias Goetz, Gross-Zimmern (DE); Seicuk Yaman, Aurach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/727,942

(22) Filed: Mar. 19, 2010

(65) Prior Publication Data

US 2010/0186212 A1 Jul. 29, 2010

Related U.S. Application Data

(63) Continuation of application No. PCT/EP2008/007830, filed on Sep. 18, 2008.

(30) Foreign Application Priority Data

Sep. 21, 2007 (DE) ..... 10 2007 045 279

(51) Int. Cl.
*H01R 43/00* (2006.01)

(52) U.S. Cl. ..... 29/857; 29/739; 29/755; 29/759; 29/854; 29/33 M

(58) Field of Classification Search ..... 29/33 M, 29/739, 741, 749, 755, 757, 759, 857, 854
See application file for complete search history.

(56) References Cited

U.S. PATENT DOCUMENTS

| | | | |
|---|---|---|---|
| 4,136,440 | A | 1/1979 | Brandewie et al. |
| 4,287,665 | A | 9/1981 | Leandris |
| 4,310,967 | A | 1/1982 | Funcik et al. |
| 4,404,743 | A | 9/1983 | Brandewie et al. |

(Continued)

FOREIGN PATENT DOCUMENTS

| | | | |
|---|---|---|---|
| DE | 9204203.1 | U1 | 9/1993 |

(Continued)

OTHER PUBLICATIONS

International Search Report for copending International Application No. PCT/EP2008/007830 dated Nov. 20, 2008, 5 pages.

*Primary Examiner* — Derris Banks
*Assistant Examiner* — Azm Parvez
(74) *Attorney, Agent, or Firm* — Barley Snyder

(57) ABSTRACT

A harness making device having at least two receiving sections, a pivoting gripping device, a cable preparation device, and a cable transfer. Each receiving section is utilized for receiving a connection mechanism. The connection mechanism, in each case, connects an end portion of a cable to a connector. The gripping device is located in a fixed position between the at least two receiving sections, and is constructed to guide the end portion of the cable to the connection mechanism. Additionally, a cable preparation device is positioned to prepare a cable loop with the cable. The cable transfer, which is constructed to receive the at least one cable from the cable preparation device, positions the cable to the pivoting gripping device.

22 Claims, 12 Drawing Sheets

U.S. PATENT DOCUMENTS

| | | | | | |
|---|---|---|---|---|---|
| 4,653,160 | A | * | 3/1987 | Thorkildsen et al. | 29/33 M |
| 5,159,749 | A | | 11/1992 | Weigert et al. | |
| 5,745,991 | A | | 5/1998 | Sorianno | |
| 5,943,751 | A | | 8/1999 | Kamei | |
| 6,079,097 | A | | 6/2000 | Henrici et al. | |

FOREIGN PATENT DOCUMENTS

| | | | |
|---|---|---|---|
| DE | 29502257.4 | U1 | 5/1995 |
| DE | 4431254 | A1 | 3/1996 |
| DE | 19750690 | A1 | 6/1999 |

* cited by examiner

HARNESS MAKING DEVICE AND METHOD FOR THE PRODUCTION OF CABLE HARNESSES

CROSS-REFERENCE TO RELATED APPLICATIONS

This application is a continuation of PCT International Application No. PCT/EP2008/007830, filed Sep. 18, 2008, which claims priority under 35 U.S.C. §119 to German Patent Application No. DE 10 2007 045 279.0, filed Sep. 21, 2007.

FIELD OF THE INVENTION

The invention relates to a harness making device, a pivoting gripping device, and a cable preparation device for use in a harness making device of this type, as well as a method for the production of cable harnesses.

BACKGROUND

Harness making devices for the automatic construction of cable harnesses, such as those used, for example, in "white goods", are known from the state of the art. In harness making devices of this type, cables are pulled from a supply, usually a cable drum, in a desired length by a robot arm and introduced to connection devices, in which said cables are connected to cable connectors. Because the robot arm requires considerable operating space, it is not possible for a plurality of connection devices to be arranged close together. Thus, the known harness making devices generally cannot produce cable harnesses with especially short cable lengths.

SUMMARY

An object of the present invention is therefore to provide a harness making device and a method, for the production of cable harnesses, so that cable harnesses with especially short cable lengths can be produced efficiently.

The harness making device includes at least two receiving sections, a pivoting gripping device, a cable preparation device, and a cable transfer. Each receiving section is utilized for receiving a connection mechanism, while the connection mechanism, in each case, connects an end portion of a cable to a connector. The gripping device is located in a fixed position between the at least two receiving sections, and is constructed to guide the end portion of the cable to the connection mechanism. Additionally, a cable preparation device is positioned to prepare a cable loop with the cable. The cable transfer, which is constructed to receive the at least one cable from the cable preparation device, positions the cable to the pivoting gripping device.

BRIEF DESCRIPTION OF THE DRAWINGS

Further details, advantages and features of this invention are given in the following description of an embodiment, in association with the drawings. In these drawings.

DETAILED DESCRIPTION OF THE EMBODIMENT(S)

An embodiment of the present invention will be described below with reference to the drawings.

Figure 1:
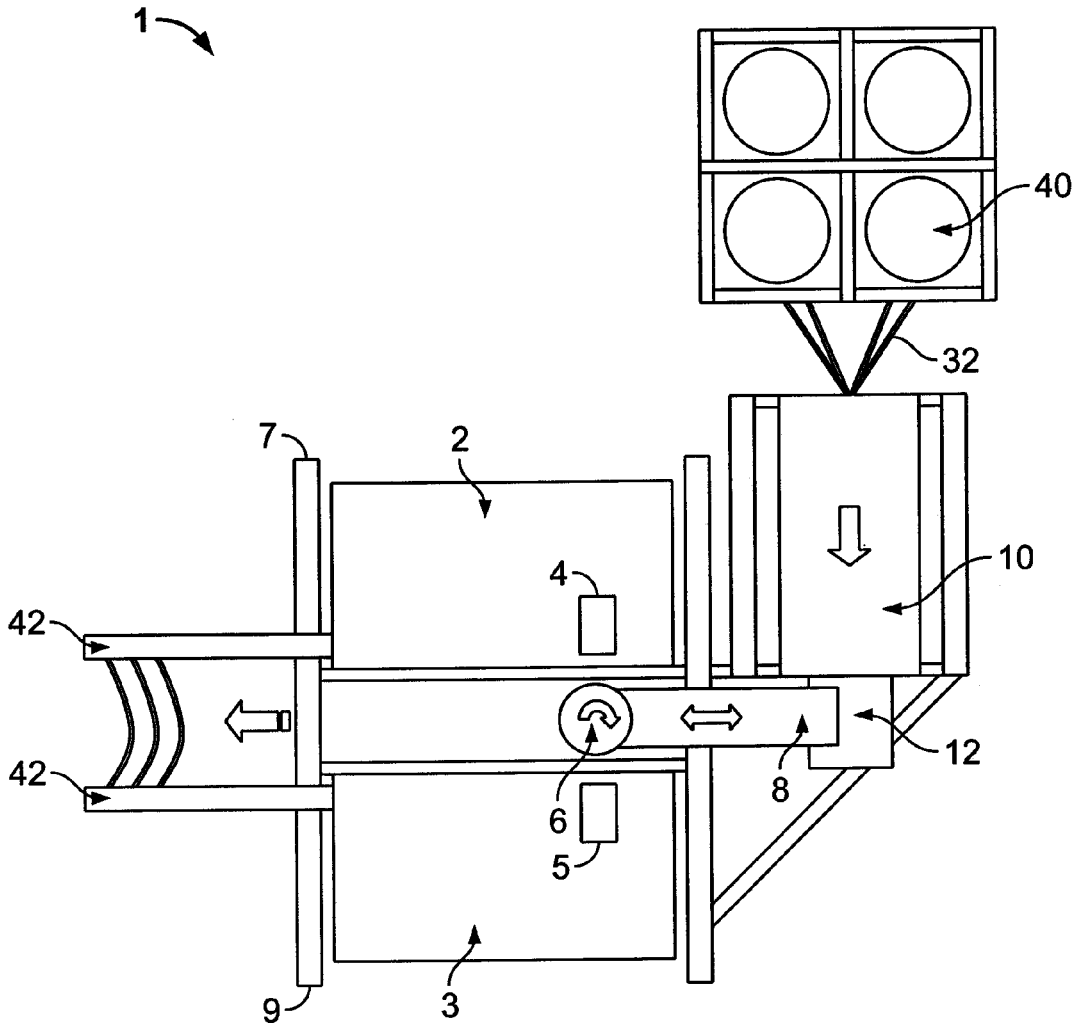
FIG. 1 is a schematic representation, in a plan view, of a harness making device according to the invention.

FIG. 1 is a schematic representation, in a plan view, of a harness making device 1 according to the invention, where the upper region of FIG. 1 shows an arrangement of four cable drums 40, from which the cable 32, used for the production of a cable harnesses, is drawn by a cable preparation device 10 arranged underneath. The cable preparation device 10 includes a loop-layer 12, which produces a cable portion of the desired length and forms a cable loop. The cable 32 prepared in this manner is taken up by the cable transfer 8, which is arranged to the left of the loop-layer 12 and extends horizontally, and transferred to the pivoting gripping device 6. On each of the two sides of the pivoting gripping device 6 (above and below the pivoting gripping device 6 in the plan view shown in FIG. 1), a receiving section 7, 9 is arranged, in each case having a connection mechanism 2, 3, each with a connector 4, 5.

The pivoting gripping device 6 positions two ends of the cable 32, which have been delivered by the cable transfer 8, in front of the desired receiving positions of the connectors 4, 5 in such a way that the ends of the cable are connected to the desired receiving section of the connector 4, 5 by the connection mechanism 2, 3.

The distance between the two connectors 4, 5, i.e. the cable length of the cable harness produced, is 140 mm in the embodiment shown in FIG. 1.

The procedure just described for the preparation of a cable 32 by the cable preparation device 10, the delivery of the prepared cable 32 to the pivoting gripping device 6 by the cable transfer 8, and the positioning of the ends of the cable 32 in front of the receiving positions of the connectors 4, 5 by the pivoting gripping device 6, as well as the connection of the ends of the cable 32 to the connectors 4, 5 by the connection mechanism 2, 3, is repeated as many times as is required for a cable harness with the desired number of cables 32 to be produced. Subsequently, the produced cable harness is released into the cable harness outlet 42.

Figure 2:
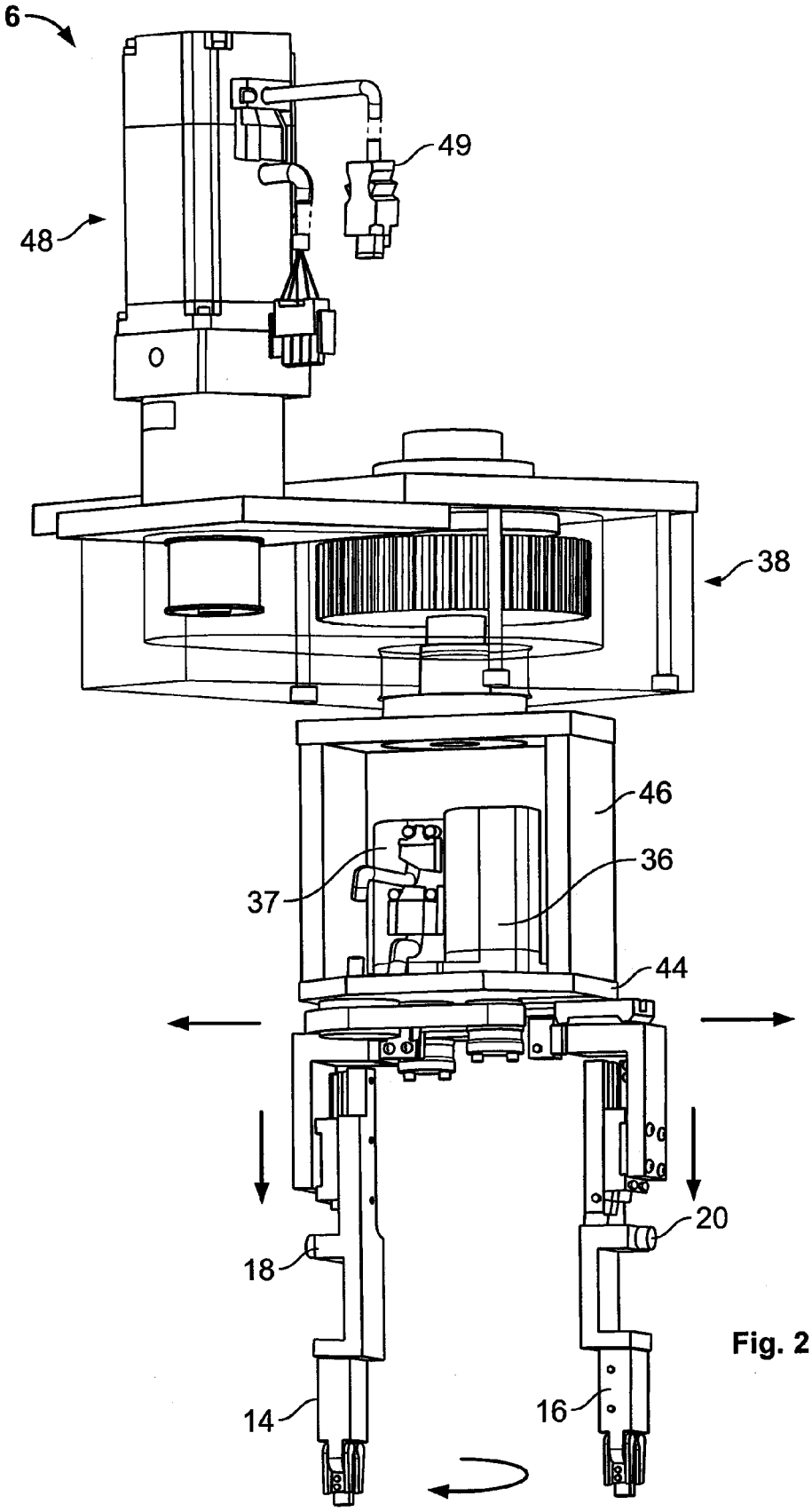
FIG. 2 is a perspective view of a pivoting gripping device for use in a harness making device according to the invention.

FIG. 2 is a perspective view of a pivoting gripping device 6 for use in a harness making device 1 according to the invention. In the embodiment shown, the pivoting gripping device 6 has two gripping arms 14, 16 for picking up one cable end each. The gripping arms 14, 16 are movable in the vertical direction. In the central region thereof, the gripping arms 14, 16 include actuators 18, 20, which the connection mechanism 2, 3 (not shown in FIG. 2) engages in order to move the gripping arm 14, 16 in the vertical direction. At the upper end thereof, the gripping arms 14, 16 are fastened to a holding plate 44 in such a way as to be laterally displaceable. On the holding plate 44, two first servo motors 36, 37 are positioned, each of which is provided for moving a respective gripping arm 14, 16. The gripping arms 14, 16 are movable by actuation of the actuators 18, 20 by one of the connection mechanisms 2, 3.

On the holding plate 44 is arranged a frame 46, which is rotatably connected to a swivel drive 38 that is arranged above the frame 46. Above the swivel drive 38, a second servo motor 48 is arranged to drive the swivel drive 38 and rotate the frame 46 together with the first servo motor 36, the holding plate 44 and the gripping arms 14 and 16. Accordingly, the gripping arms 14, 16 can thus be moved by the connection mechanism 2, 3 without the pivoting gripping device 6 having to have its own drive for moving the gripping arms 14, 16.

Control and supply cables 49 are attached to the second servo motor 48, in order to supply current and control signals to the pivoting gripping device 6.

With the vertical construction shown in FIG. 2, in which the gripping arms 14, 16, the first servo motors 36, 37, the swivel drive 38 and the second servo motor 48 are arranged vertically with respect to one another, the pivoting gripping device 6 has a minimized width, which provides a construction that can even be used between receiving sections 7, 9, which are arranged close to one another. The gripping arms 14, 16 are rotatable in a plane that lies parallel to the end portion of the cable 32. In this way, both end portions of the cable 32 can be connected with the same connector 4, 5 when using a connection mechanism 2, 3. Accordingly, the pivoting gripping device 6 requires little lateral space, in such a way that at least two receiving sections 7, 9 can be arranged opposite one another at a small distance. It is thus possible, with a harness making device 1 according to the invention, to produce cable harnesses with an especially short cable length.

Figure 3:
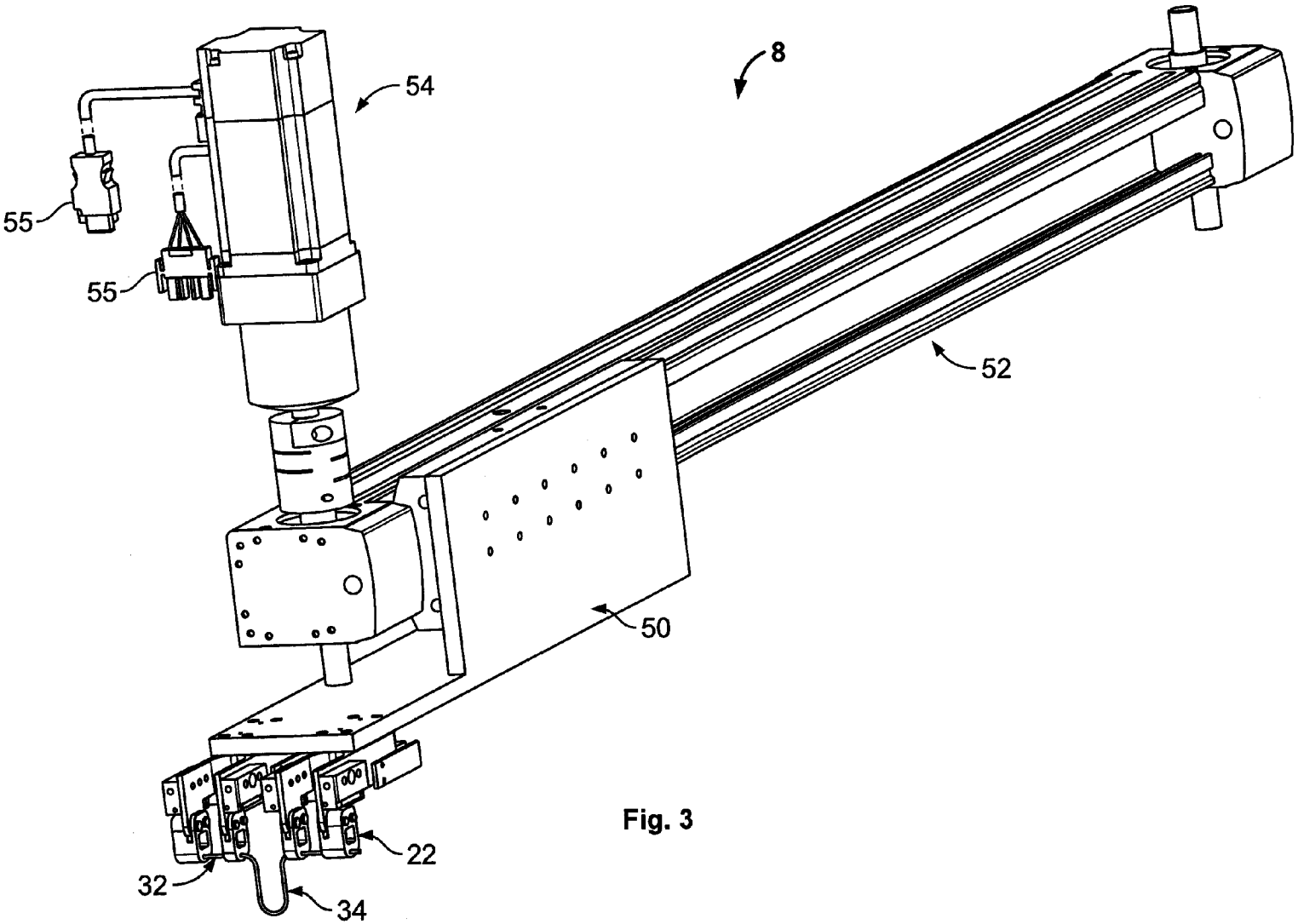
FIG. 3 is a perspective view of a cable transfer for use in a harness making device according to the invention.

FIG. 3 shows a cable transfer 8 for use in a harness making device 1 according to the invention. In the region shown below on the left-hand side in FIG. 3, the cable transfer 8 includes four cable transfer grippers 22, which hold a cable 32 with a loop 34. The cable transfer grippers 22 are fastened to a cable transfer slide 50 arranged above them. The cable transfer slide 50 is held by a cable transfer rail 52, which extends diagonally upwards and on which said slide is displaceable. Above the cable transfer rail 52, at the left-hand end thereof, is arranged a third servo motor 54, which moves the cable transfer slide 50, for example via a toothed belt (not shown) along the cable transfer rail 52, in order to transfer the cable 32 from the loop-layer 12 (not shown in FIG. 3) to the pivoting gripping device 6 (not shown in FIG. 3).

Control and supply cables 55 are attached to the third servo motor 54 to supply current and control signals to the cable transfer 8.

Figure 4:
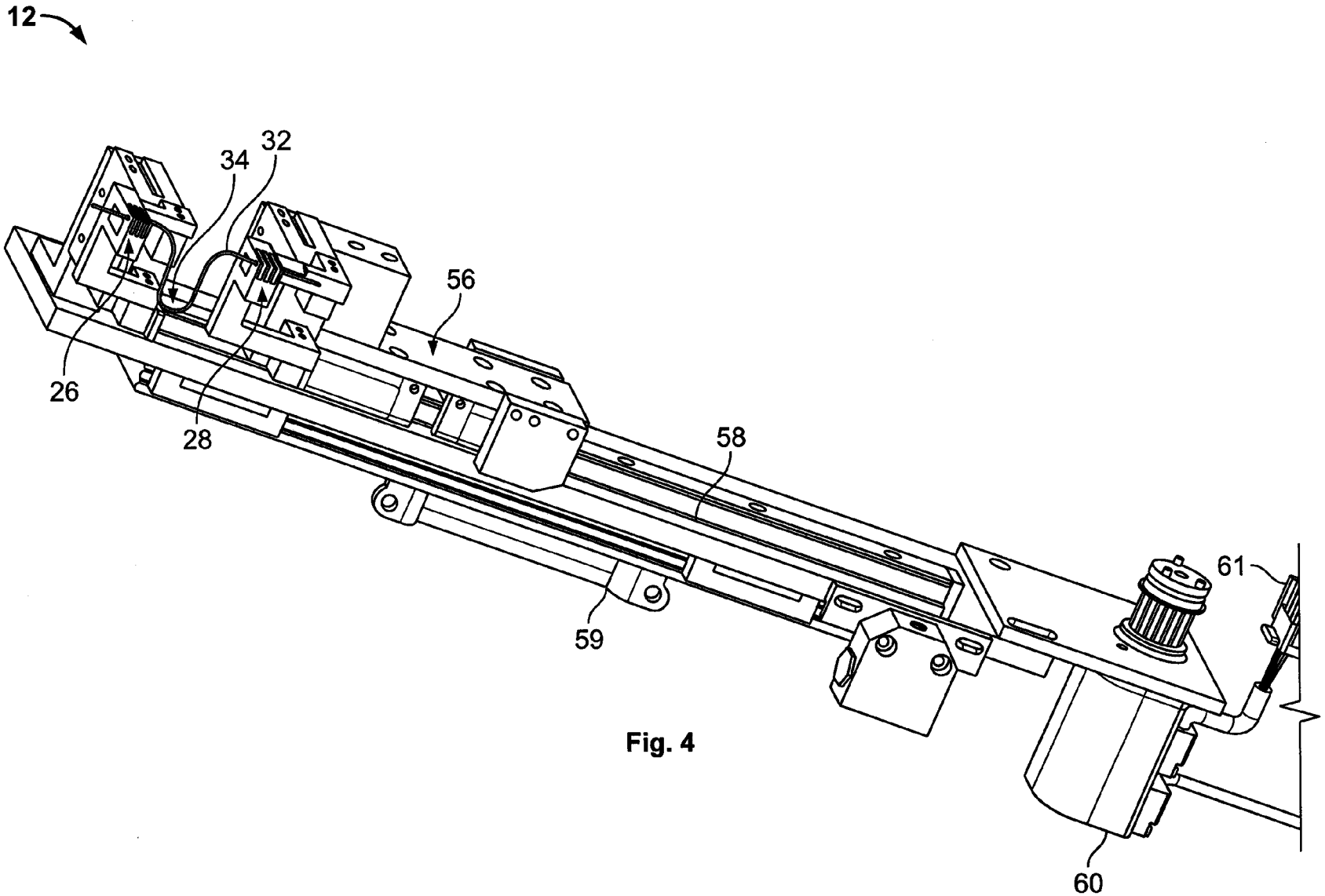
FIG. 4 is a perspective view of a loop-layer for use in a harness making device according to the invention.

FIG. 4 shows a loop-layer 12 for use in a harness making device 1 according to the invention. In the region shown on the left in FIG. 4, the loop-layer 12 includes a fixed gripper 26, and a movable gripper 28 to the right thereof. The two grippers 26, 28 hold a cable 32 with a loop 34. The fixed gripper 26 is mounted fixedly on the on the rail 58 of the loop-layer 12. The movable gripper 28 is mounted on a slide 56, which is mounted on the rail 58 and movable along the rail. At the right-hand end of the rail 58, below the rail 58, is arranged a fourth servo motor 60, which drives the slide 56, for example by use of a toothed belt (not shown). By opening and closing the grippers 26, 28 and moving the movable grippers 28, the desired length of the cable 32 can be measured off and a loop 34 can be laid down.

Control and supply cables 61 are attached to the fourth servo motor 60 to supply current and control signals to the loop-layer 12. A fastener 59 is provided below the rail 58 in order to fasten the loop-layer to, for example, a frame.

FIGS. 5 to 12 show method steps for the production of cable harnesses.

Figure 5:
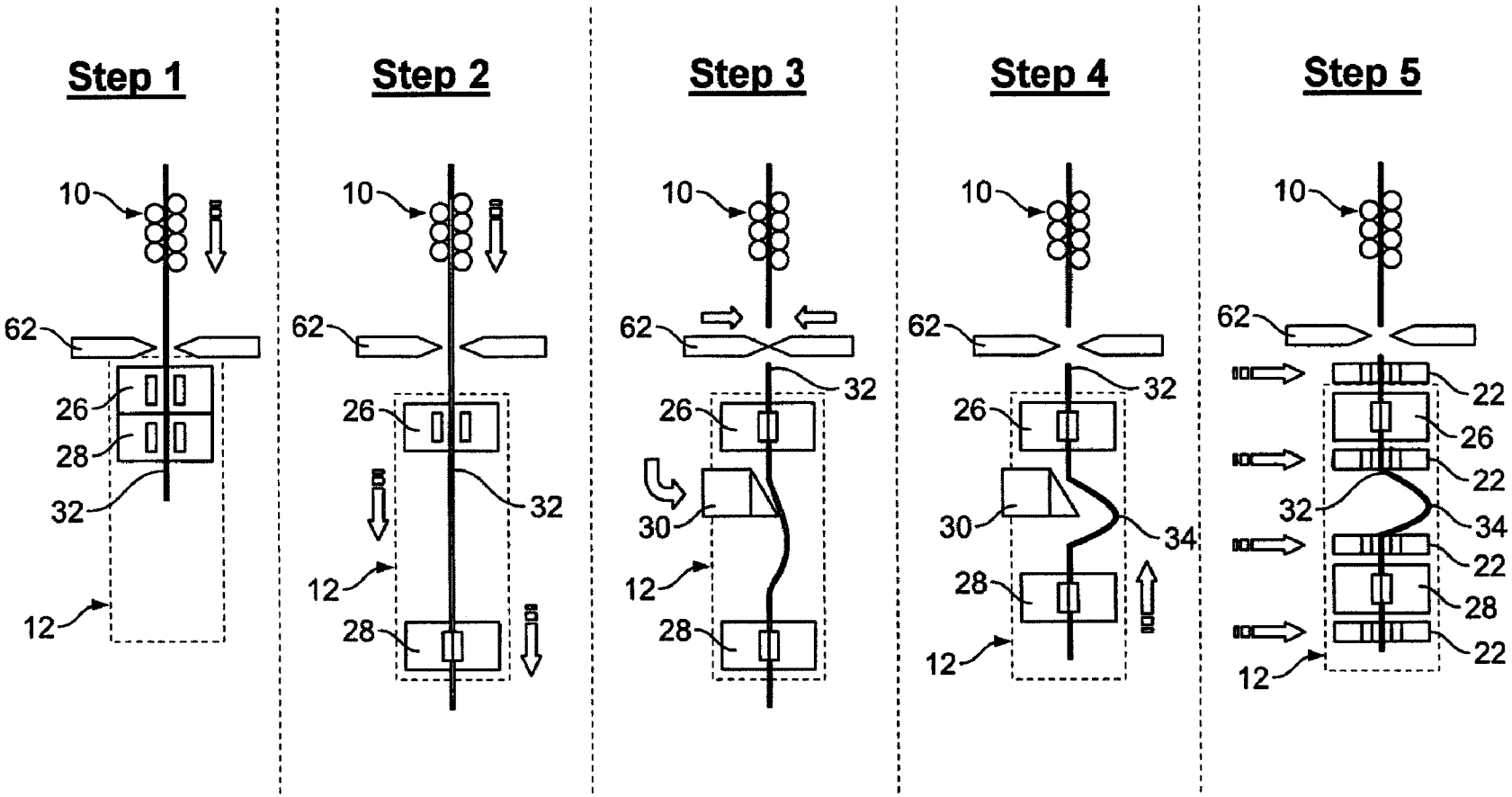
FIG. 5 shows method steps for the production of cable harnesses.

FIG. 5 shows, in steps 1 to 4, the measuring off of the desired cable length and the laying down of the loop 34 in the loop-layer 12.

In the first step, the movable gripper 28 is guided up against the fixed gripper 26. The loop-layer 12 is positioned in such a way as to lie against a cutting knife 62. A cable 32 is guided through between the blades of a cutting knife 62, into the open grippers 26, 28 of the loop-layer 12, by the cable preparation device 10.

In the second step, the movable gripper 28 is closed and has been distanced from the fixed gripper 26 in accordance with the desired cable length. The fixed gripper 26 opens again. Moreover, the loop-layer 12 has been distanced somewhat from the cutting knife 62, in such a way that a piece of the cable remains between the cutting knife 62 and the fixed gripper 26.

In the third step, the cable 32 is fixed by closing the fixed gripper 26. By closing the blades of the cutting knife 62, the cable 32 is cut to the desired length. In addition, a cable hold-down 30 is introduced into the region between the fixed gripper 26 and the movable gripper 28, to hold the cable down.

In the fourth step, with both of the grippers 26, 28 being closed, the movable gripper 28 moves onto the fixed gripper 26. In this way, the cable 32 forms a loop 34 in cooperation with the cable hold-down 30. The cable hold-down 30 holds the cable 32 down when laying down the loop 34. This ensures that the loop 34 is formed in a defined direction, increasing the reliability and operating safety of the loop-layer 12.

In the fifth step, two cable transfer grippers 22 move to either side of the movable gripper 28 and the fixed gripper 26. In the process, the distance between the cable transfer grippers 22 is dimensioned in such a way that the movable gripper 28 and the fixed gripper 26 each fit between two cable transfer grippers 22.

Figure 6:
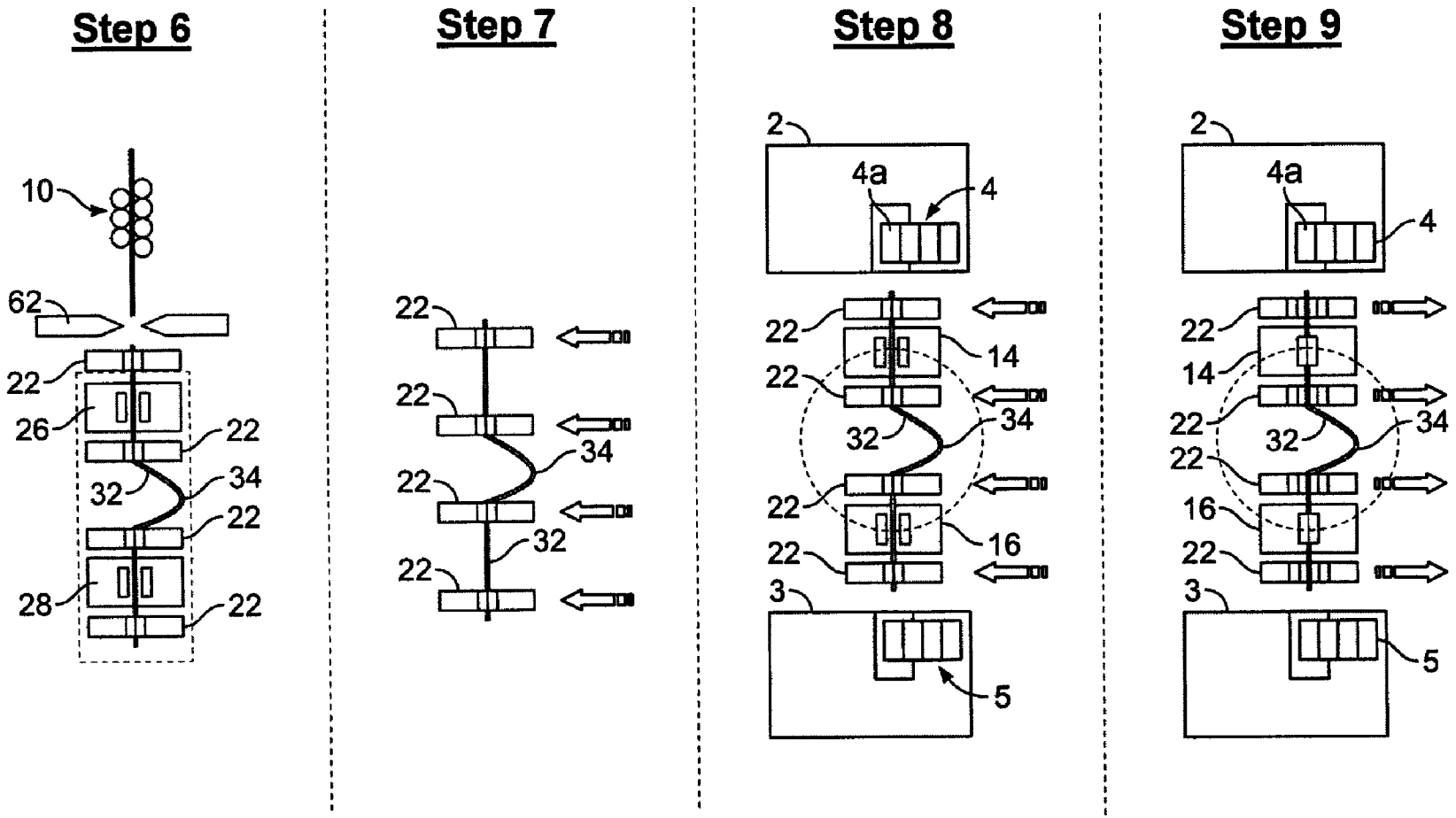
FIG. 6 show additional method steps for the production of the cable harnesses.

FIG. 6 shows, in steps 6 to 8, the transfer by the cable transfer 8 of a cable prepared by the loop-layer 12.

In the sixth step, the gripping arms of the transfer grippers 22 close and the fixed gripper 26 and the movable gripper 28 of the loop-layer 12 open.

In the seventh step, the cable 32 is transferred from the loop-layer 12 in the direction of the connection mechanism 2, 3 (not shown) by the cable transfer grippers 22.

In the eighth step, the cable transfer grippers 22 have positioned the cable 32 in the still open gripping arms 14, 16 of the pivoting gripping device 6 between the receiving sections 7, 9. In the process, the distance between the cable transfer grippers 22 is dimensioned in such a way that a gripping arm 14, 16 of the pivoting gripping device 6 fits between two cable transfer grippers 22 in each case.

In the ninth step, the gripping arms 14, 16 of the pivoting gripping device 6 close in order to hold the cable 32, and the cable transfer grippers 22 open in order to release the cable 32. The cable transfer grippers 22 move out of the region of the pivoting gripping device 6.

Figure 7:
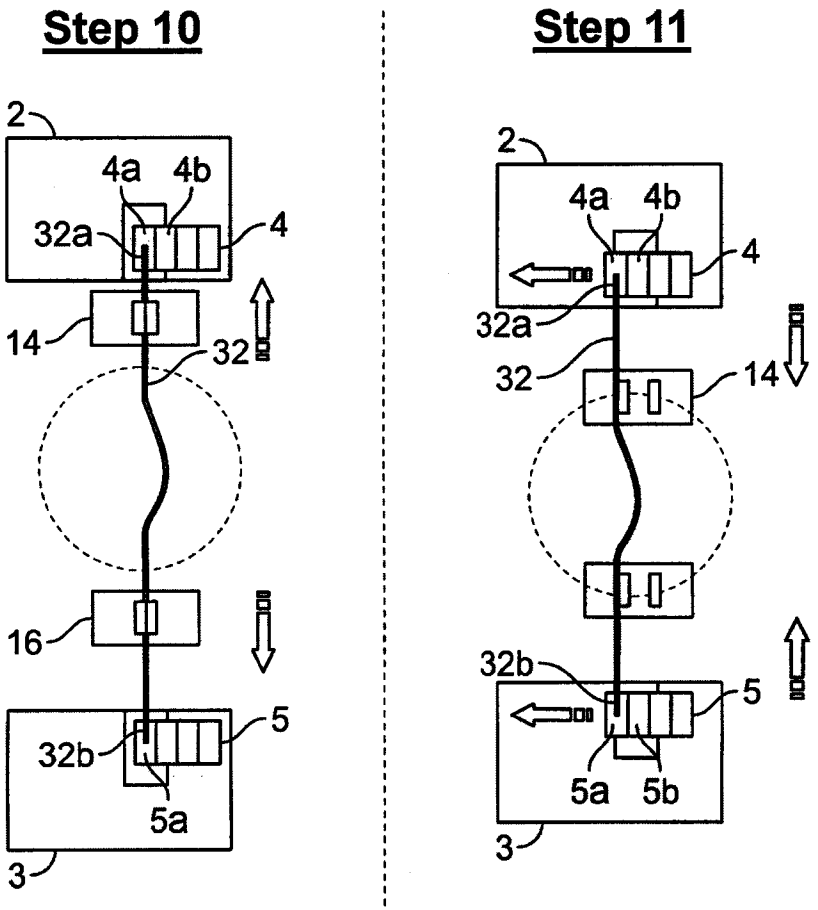
FIG. 7 show additional method steps for the production of the cable harnesses.

FIG. 7 shows the connection of the two ends of the cable 32 to the connectors 4, 5 in the connection mechanism 2, 3 for the production of what is known as a jumper connection.

In the tenth step, the connectors 4, 5 are arranged in the connection mechanism 2, 3 in such a way that the first receiving positions 4*a*, 5*a* of the connectors 4, 5 thereof lie opposite the ends of the cable 32. The gripping arms 14, 16 move in the direction of the connection mechanism 2, 3 in such a way that the cable ends 32*a*, 32*b* are introduced into the connectors 4, 5. The cable ends 32*a*, 32*b* connect to the connectors 4, 5 in a step not shown in FIG. 7.

In the eleventh step, the gripping arms 14, 16 of the pivoting gripping device 6 open in order to release the cable 32 and move back into the starting position to receive a further cable 32. The connectors 4, 5 are displaced within the connection mechanism 2, 3 perpendicular to the extension of the cable 32 in such a way that in the next step, the ends of the cable 32 are arranged opposite two receiving positions 4*b* and 5*b*. In this way, respectively, opposite connection sites of the connectors 4, 5 are connected by a cable 32.

Figure 8:
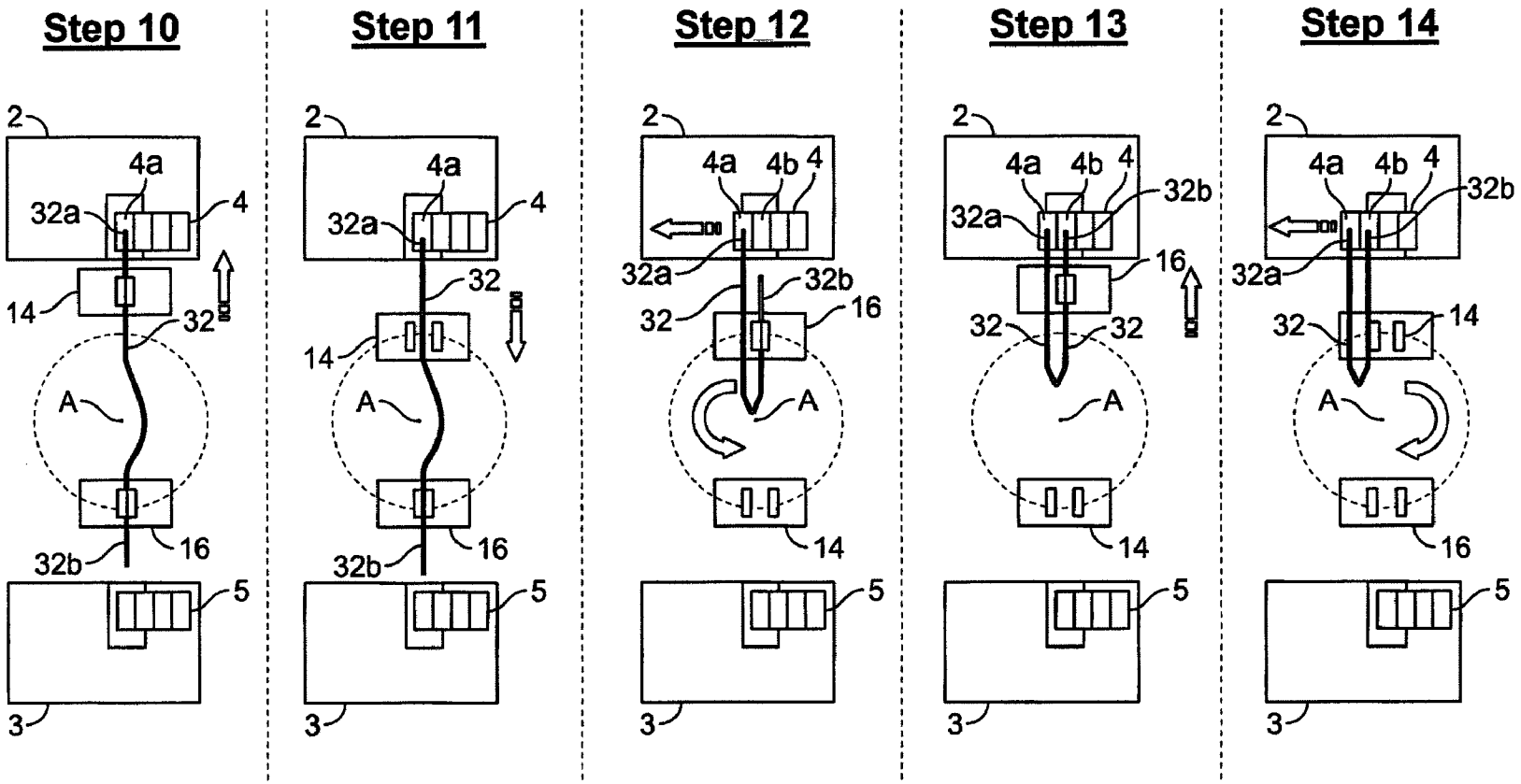
FIG. 8 show additional method steps for the production of the cable harnesses.

The method shown in FIG. 8 follows on from the ninth step shown in FIG. 6 and represents a method for the production of a bridge connection.

In the tenth step, only the first gripping arm 14 is displaced in the direction of the first connection mechanism 2, in such a way that the first cable end 32*a* of the cable 32 is introduced into a first receiving position 4*a* of the first connector 4 and connects thereto.

The second gripping arm 16 remains in the starting position thereof.

In the eleventh step, the first gripping arm 14 is released, and moves into the starting position thereof, whilst the second gripping arm 16 remains closed.

In the twelfth step, the gripping arms 14, 16 together perform a 180° rotation about an axis, A, lying in between them, in such a way as to swap positions. Simultaneously, the first connector 4 is displaced in a plane perpendicular to the cable 32 by the first connection mechanism 2 in such a way that the second cable end 32*b* of the cable 32 is positioned opposite a second receiving position 4*b* of the first connector 4.

In the thirteenth step, the second gripping arm 16 moves in the direction towards the first connection mechanism 2 in such a way that the second cable end 32*b* of the cable 32 is introduced into the second receiving position 4*b* of the first connector 4. The second cable end 32*b* of the cable 32 connects to the second receiving position 4*b* of the first connector 4 by the first connection mechanism 2, in order to construct a bridge connection on the first connector 4.

In the fourteenth step, the second gripping arm 16 opens and the two grippers rotate once again by 180° about the common axis A, in order to restore the starting position.

Figure 9:
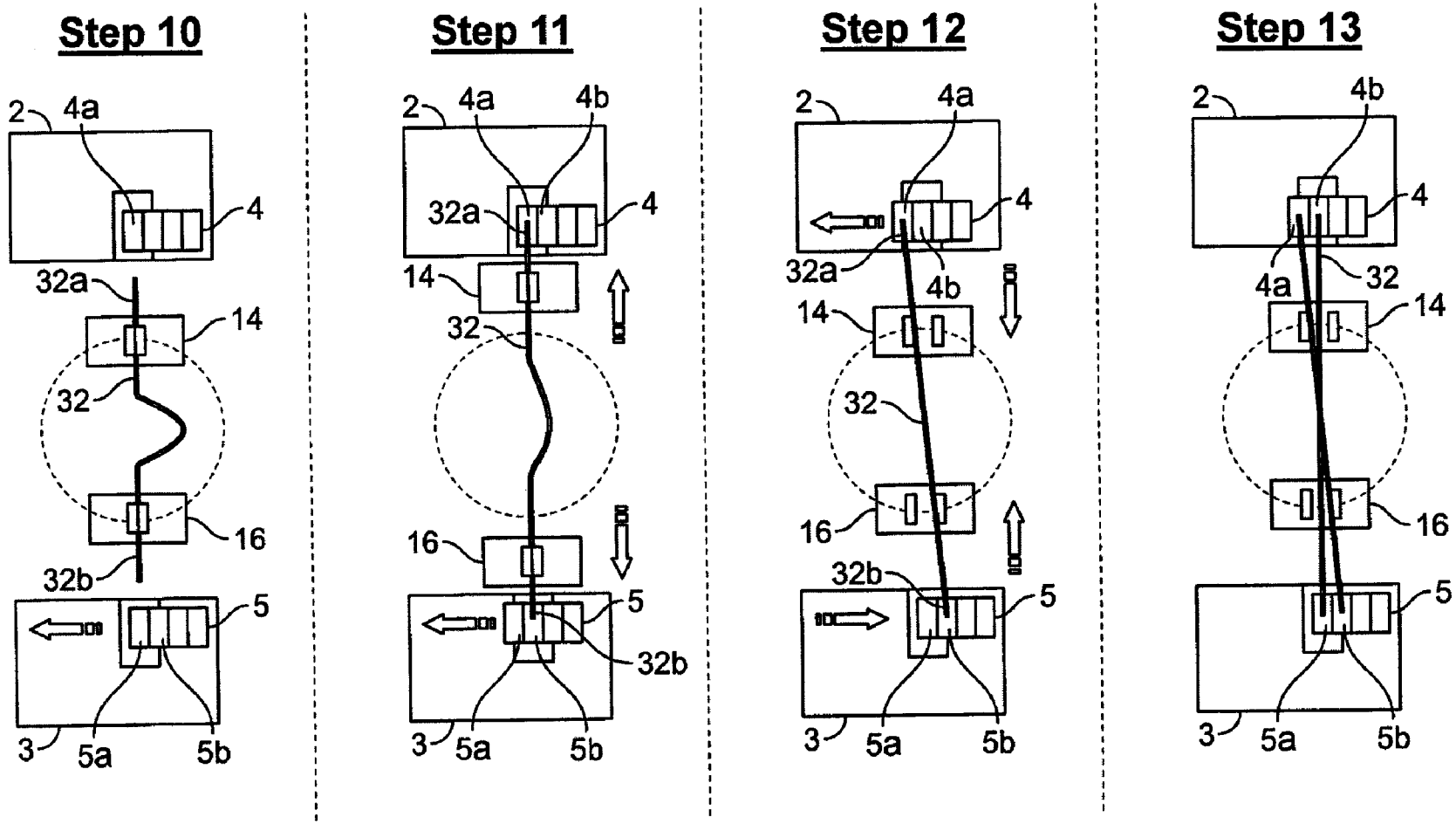
FIG. 9 show additional method steps for the production of the cable harnesses.

FIG. 9 likewise follows on from the ninth step shown in FIG. 6 and shows a method for the production of crossover connections.

In the tenth step, the second connector 5 moves to the left by the second connection mechanism 3 in such a way that the second cable end 32*b* is positioned opposite a second receiving position 5*b* of the second connector 5.

In the eleventh step, the gripping arms 14, 16 each move in the direction of the connection mechanism 2, 3 in such a way that the first cable end 32*a* is introduced into the first receiving position 4*a* of the first connector 4 and the second cable end 32*b* is introduced into the second receiving section 5*b* of the second connector 5. Thereupon, the first cable end 32*a* connects to the first receiving position 4*a* of the first connector 4 and the second cable end 32*b* connects to the second receiving section 5*b* of the second connector 5.

In the twelfth step, the gripping arms 14, 16 of the pivoting gripping device 6 opens in such a way as to release the cable 32, and then moves into the starting position.

The first connector 4 moves to the left by the first connection mechanism 2 in such a way that a second receiving position 4*b* of the first connector 4 is positioned in front of the first gripping arm 14. The second connector 5 moves to the right by the second connection mechanism 3 in such a way that the first receiving position 5*a* of the second connector 5 is positioned in front of the second gripping arm 16.

The next figure, for the thirteenth step, shows the state after a second cable 32 has been connected between the second receiving position 4*b* of the first connector 4 and the first receiving position 5*a* of the second connector 5 in such a way that a cable harness with a crossover has been produced.

Figure 10:
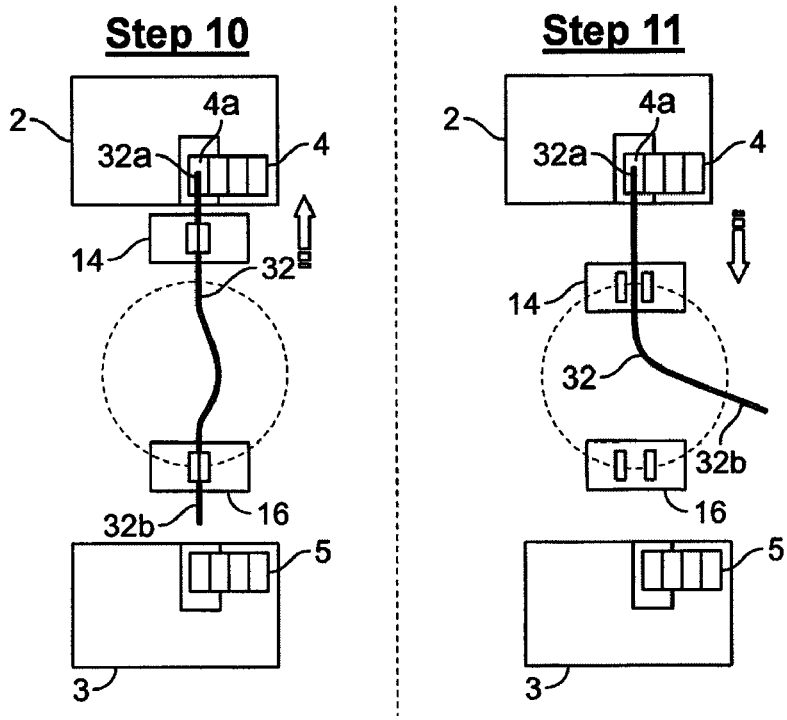
FIG. 10 show additional method steps for the production of the cable harnesses.

The method shown in FIG. 10 likewise follows on from the ninth step shown in FIG. 6 and represents a method for the production of a cable harness with a free end.

Cable harnesses of this type can be produced with short cable lengths of less than 60 mm, preferably less than 50 mm.

In the tenth step, the first gripping arm 14 is moved in the direction of the first connection mechanism 2 in such a way that the first cable end 32*a* is introduced into a first receiving position 4*a* of the first connector 4 and fastened there. The second gripping arm 16 remains in the starting position thereof.

In the eleventh step, the gripping arms 14 and 16 are opened in such a way as to release the cable 32. In particular, the second gripping arm 16 drops the second cable end 32*b* of the cable 32.

By displacing the connector 4 by means of the connection mechanism 2 and repeating steps 10 and 11, a cable harness with a connector 4 and cable ends 32*b* is produced.

A cable harness of this type may alternatively also be produced using the second connection mechanism 3.

Figure 11:
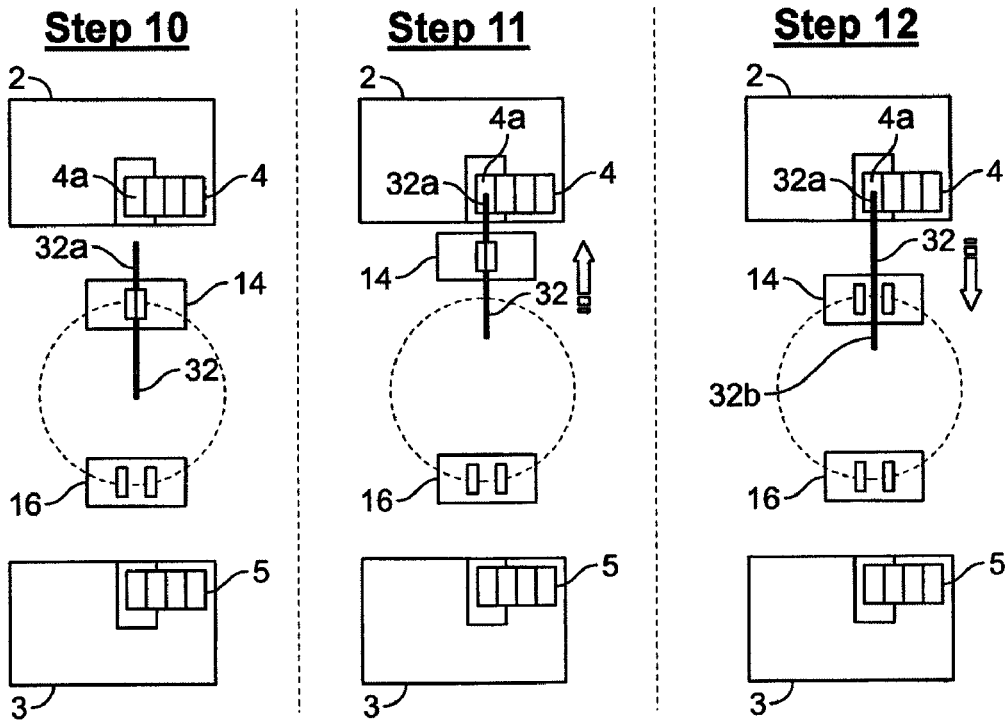
FIG. 11 show additional method steps for the production of the cable harnesses.

The method shown in FIG. 11 likewise follows on from the ninth step shown in FIG. 6 and represents a method for fastening a short cable with a free end.

In the tenth step, the short cable 32 is held only by the first gripping arm 14. A first receiving position 4*a* of the first connector 4 is arranged opposite the first cable end 32*a* of the short cable 32.

In the eleventh step, the first gripping arm 14 is moved in the direction of the first connection mechanism 2, in such a way that the first cable end 32*a* is introduced into the first receiving position 4*a* of the first connector 4 and fastened there.

In the twelfth step, the first gripping arm 14 is opened and moved into the starting position. In particular, the second cable end 32*b* of the short cable 32 is dropped.

Figure 12:
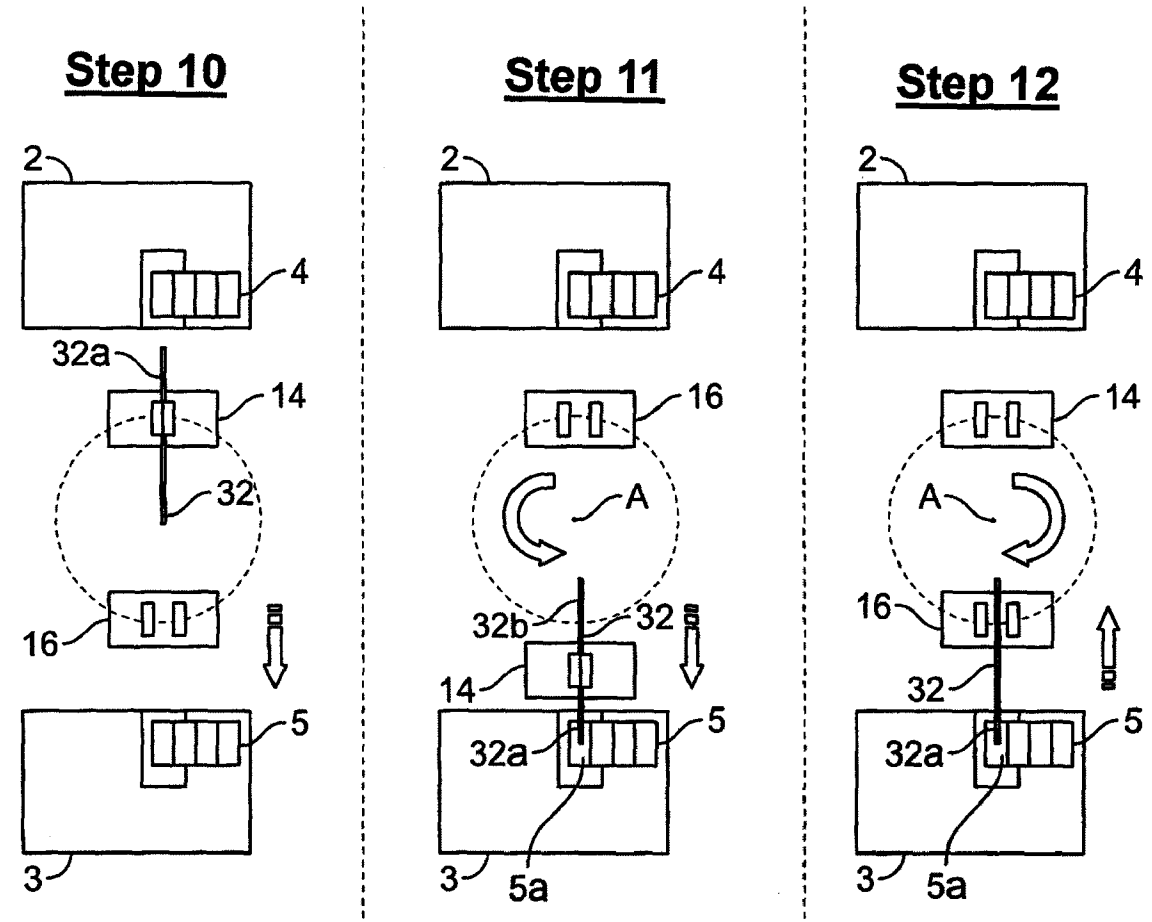
FIG. 12 show additional method steps for the production of the cable harnesses.

FIG. 12 shows an alternative method, which likewise follows on from the ninth step shown in FIG. 6, for the connection of a short cable 32 with a free end.

In the tenth step, the short cable 32 is held only by the first gripping arm 14.

In the eleventh step, the first and second gripping arms 14, 16 rotate together by 180° about an axis A lying there between, in such a way as to swap positions. The first cable end 32*a* is thus positioned opposite a first receiving position 5*a* of a second connector 5 in the second connection mechanism 3. The first gripping arm 14 moves in the direction of the second connection mechanism 3 in such a way that the first cable end 32*a* is introduced into the first receiving position 5*a* of the second connector 5 and connects thereto.

In the twelfth step, the first gripping arm 14 opens. In particular, the second cable end 32*b* of the cable 32 is dropped. The first and second gripping arm 14, 16 rotate back about the common axis A thereof into the starting position.

FIG. 13 shows three different examples of cable harnesses.

Figure 13A:
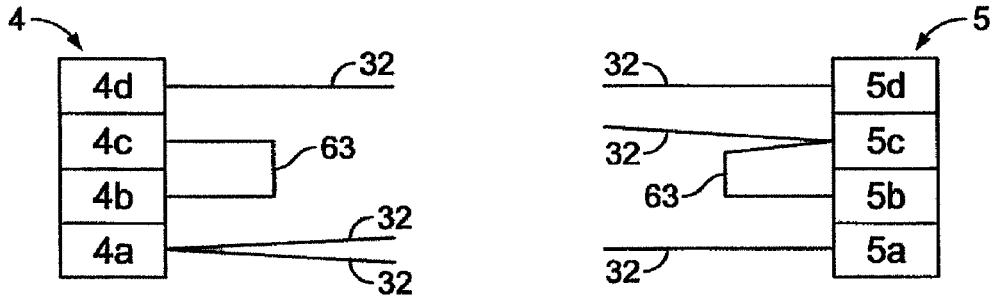
FIG. 13 shows examples of connection diagrams for various cable harnesses.

FIG. 13*a* shows cable harnesses with one-sided contact, i.e. with free ends and bridges. The first connector 4 on the left-hand side includes a bridge 63 between the receiving positions 4*b* and 4*c*. Two cables 32 with free ends are fastened in the first receiving positions 4*a*. A cable 32 with a free end is fastened in the receiving position 4*d*.

The second connector 5, shown on the right-hand side, includes a cable 32 with a free end in each of the receiving positions 5*a*, 5*c* and 5*d*. In addition, a bridge 63 forms between the receiving positions 5*b* and 5*c*.

Figure 13B:
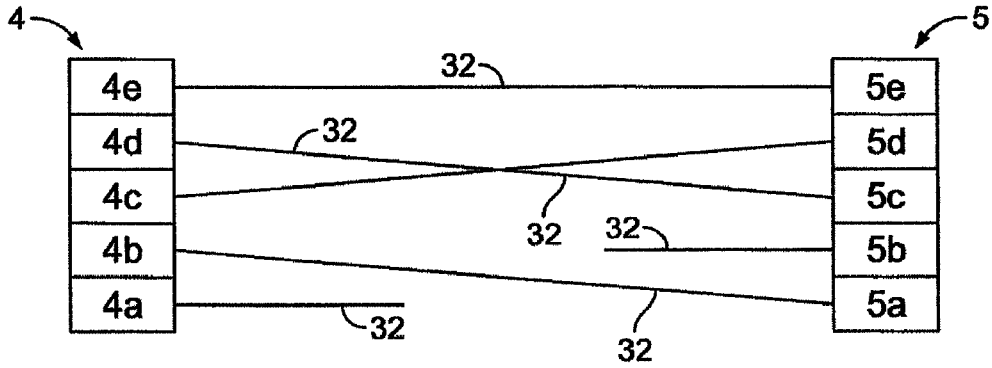

The cable harness shown in FIG. 13*b* includes a jumper connection between the receiving positions 4*e* and 5*e*. The receiving positions 4*c* and 5*d*, as well as 4*d* and 5*c*, connect to one another with a crossover connection. The second receiving position 4*b* connects to the receiving position 5*a*.

The receiving positions 4*a* and 5*b* each include a cable 32 with a free end.

Figure 13C:
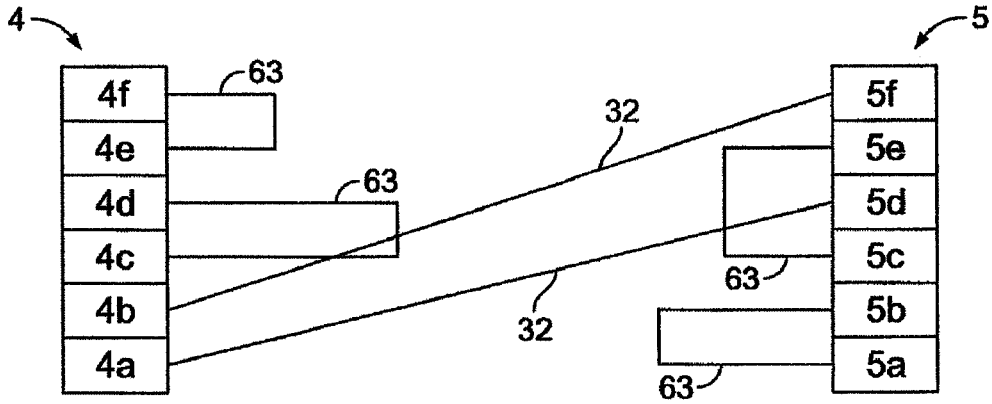

FIG. 13*c* shows a cable harness with two-sided contact and bridge connections.

The first receiving position 4*a* connects to the receiving position 5*d* by a cable 32. The second receiving position 4*b* connects to the receiving position 5*f* by a cable 32. The first connector 4 further includes a bridge connection in each case between the receiving positions 4*c* and 4*d* and between the receiving positions 4*e* and 4*f*. The second connector 5 includes a bridge connection between the receiving positions 5*a* and 5*b* and a bridge connection between the receiving positions 5*c* and 5*e*.

According to the invention, the harness making device 1 is constructed for the production of plug connections in one embodiment, in particular for the production of IDC connections, such as those frequently used in cable harnesses.

In another embodiment, the connection mechanism 2, 3 is constructed in such a way that the used connector(s) 4, 5 can be moved in a plane, which is perpendicular to the end portion of the cable 32, so that the end portion of the cable 32 can optionally be positioned in front of one of a plurality of receiving passageways of the connector. In this way, it is possible to produce various cable harnesses with different wiring patterns in a simple manner.

According to the invention, the harness making device is constructed in such a way that the introduction and connection of at least one end portion of a first cable can be carried out simultaneously with the transfer of a second cable and simultaneously with the preparation of a third cable. In this way, the harness making device can be operated particularly efficiently and a large number of cable harnesses can be produced per unit time.

The features, embodiments and advantages which have been disclosed in relation to the harness making device for the production of cable harnesses may also be realised by method steps for the production of a harness making device according to the invention.

Besides these, the configurations described in the above-described embodiment can be selected optionally or can be changed appropriately in to other configurations without departing from the spirit and scope of the present invention.

The invention claimed is:

1. A harness making device, comprising:

at least two receiving sections, each receiving section receiving a connection mechanism connecting an end portion of a cable to a connector;

a pivoting gripping device having a gripping arm and positioned in a fixed position between the at least two receiving sections and constructed to guide the end portion of the cable to the connection mechanism;

a cable preparation device for forming a cable loop from the cable; and a cable transfer constructed to receive the cable from the cable preparation device and transfer the cable to the pivoting gripping device;

wherein the gripping arm is rotatable in a plane lying parallel to the end portion.

2. The harness making device according to claim 1, wherein a distance between the receiving sections is less than 150 mm.

3. The harness making device according to claim 2, wherein the distance between the receiving sections is less than 140 mm.

4. The harness making device according to claim 1, wherein the harness making device is constructed for the production of plug connections.

5. The harness making device according to claim 1, wherein the connection mechanism moves the connector in a plane perpendicular to the end portion of the cable, the cable optionally positioned in front of one or more receiving positions of the connector.

6. The harness making device according to claim 1, wherein the gripping arm is movable parallel to the end portion in the direction of the connector.

7. The harness making device according to claim 6, wherein the gripping arm is movable in a direction perpendicular to the end portion.

8. The harness making device according to claim 7, wherein the gripping arm includes an actuator, the gripping arm movable by actuation of the actuator by the connection mechanism.

9. The harness making device according claim 1, wherein the cable transfer includes a cable transfer gripper movable between the cable preparation device and the pivoting gripping device.

10. The harness making device according claim 9, wherein the cable transfer gripper is movable in a substantially straight line.

11. The harness making device according claim 1, wherein the cable transfer includes at least two cable transfer grippers, the distance between the at least two cable transfer grippers being greater than the width of the gripper arm of the pivoting gripping device.

12. The harness making device according claim 1, wherein the cable preparation device includes a loop-layer for measuring off a desired cable length.

13. The harness making device according to claim 12, wherein the loop-layer includes a fixed gripper and a movable gripper for gripping the cable, a loop of a cable being formed by moving the movable gripper relative to the fixed gripper.

14. The harness making device according to claim 13, wherein the movable gripper is movable in a substantially straight line.

15. The harness making device according to claim 13, wherein the loop-layer further includes a cable hold-down for holding down the cable during the formation of the loop.

16. The harness making device according claim 1, wherein the guidance and connection of the end portion of the cable is carried out simultaneously with a transfer of a second cable, and in parallel with preparation of a third cable.

17. The harness making device according to claim 1, wherein the pivoting gripping device includes a gripping arm and a first servo motor to move the gripping arm in a direction parallel to the end portion of the cable.

18. The harness making device according to claim 17, wherein the pivoting gripping device further includes a swivel drive to rotate the pivoting gripping device.

19. The harness making device according to claim 18, wherein the swivel drive is attached above the first servo motor.

20. The harness making device according to claim 18, wherein the pivoting gripping device further includes another gripping arm, each gripping arm constructed to move the end portion of the cable to the connection mechanism.

21. The harness making device according to claim 20, wherein the two gripping arms are rotatable together about an axis arranged between the two gripping arms.

22. The harness making device according to claim 21, wherein the cable preparation device includes a loop-layer for measuring off the desired cable length.

* * * * *